US006685184B2

(12) United States Patent
Tufekci et al.

(10) Patent No.: US 6,685,184 B2
(45) Date of Patent: Feb. 3, 2004

(54) TRANSPORT METHOD AND SYSTEM FOR CONTROLLING TIMING OF MAIL PIECES BEING PROCESSED BY A MAILING SYSTEM

(75) Inventors: Celal S. Tufekci, West Haven, CT (US); Gary S. Jacobson, Norwalk, CT (US)

(73) Assignee: Pitney Bowes Inc, Stamford, CT (US)

( * ) Notice: Subject to any disclaimer, the term of this patent is extended or adjusted under 35 U.S.C. 154(b) by 0 days.

(21) Appl. No.: 10/382,436

(22) Filed: Mar. 6, 2003

(65) Prior Publication Data

US 2003/0168798 A1 Sep. 11, 2003

Related U.S. Application Data

(60) Provisional application No. 60/363,648, filed on Mar. 11, 2002.

(51) Int. Cl.[7] ..... B65H 5/34

(52) U.S. Cl. ..... 271/270; 271/258.01; 271/259; 271/265.01; 271/265.02

(58) Field of Search ..... 271/258.01, 259, 271/265.01, 265.02, 270, 10.02, 10.03

(56) References Cited

U.S. PATENT DOCUMENTS 4,331,328 A * 5/1982 Fasig ..... 271/270
4,451,027 A 5/1984 Alper
4,541,624 A 9/1985 Sasage et al.
4,691,912 A * 9/1987 Gillmann ..... 271/10.02
4,933,616 A 6/1990 Chang et al.
4,935,078 A 6/1990 Bergman et al.
4,978,114 A 12/1990 Holbrook
5,056,771 A * 10/1991 Beck et al. ..... 271/114
5,112,038 A * 5/1992 Dunaway ..... 271/10.03
5,197,726 A * 3/1993 Nogami ..... 271/110
5,295,677 A * 3/1994 Hutner ..... 271/110
5,423,527 A * 6/1995 Tranquilla ..... 271/10.02
5,575,466 A * 11/1996 Tranquilla ..... 271/10.03
5,692,741 A * 12/1997 Nakamura et al. ..... 271/10.03
5,692,742 A * 12/1997 Tranquilla ..... 271/10.03
5,813,327 A 9/1998 Freeman et al.
5,848,784 A * 12/1998 Tranquilla ..... 271/10.03
5,924,686 A 7/1999 Jacobson et al.
6,023,034 A * 2/2000 Nakajima et al. ..... 209/584
6,076,821 A * 6/2000 Embry et al. ..... 271/10.01
6,126,160 A * 10/2000 Ebert et al. ..... 271/10.03
6,354,583 B1 * 3/2002 Skadow et al. ..... 271/10.03
6,499,020 B1 12/2002 Dolan et al.
6,533,264 B1 * 3/2003 Tranquilla ..... 271/10.02
6,550,764 B2 * 4/2003 Wilson et al. ..... 271/270
6,554,275 B1 * 4/2003 Tranquilla ..... 271/259

* cited by examiner

*Primary Examiner*—Donald P. Walsh
*Assistant Examiner*—Matthew J. Kohner
(74) *Attorney, Agent, or Firm*—Brian A. Lemm; Angelo N. Chaclas; Charles R. Malandra, Jr.

(57) ABSTRACT

A transport method and system that operates to feed mixed size mail pieces in singular fashion and adaptively controls the velocity of the mail pieces such that overall system performance is optimized is provided. The length of a mail piece is measured and a desired gap time between the mail piece and a subsequent mail piece is calculated. The gap time between the mail piece and the subsequent mail piece is measured, and a difference between the desired gap time and measured gap time is calculated. Based on the calculated gap time difference, the velocity of the subsequent mail piece is adaptively controlled to decrease the difference between the desired gap time and the measured gap time such that the measured gap time is adjusted to be approximately equal to the desired gap time, thereby optimizing throughput of the mailing system.

58 Claims, 8 Drawing Sheets

TRANSPORT METHOD AND SYSTEM FOR CONTROLLING TIMING OF MAIL PIECES BEING PROCESSED BY A MAILING SYSTEM

CROSS-REFERENCE TO RELATED APPLICATIONS

This application claims priority from U.S. Provisional Application Ser. No. 60/363,648, filed on Mar. 11, 2002, the specification of which is hereby incorporated by reference.

FIELD OF THE INVENTION

The invention disclosed herein relates generally to mailing systems, and more particularly to a transport method and system for controlling the timing of articles being processed by a mailing system.

BACKGROUND OF THE INVENTION

Mailing systems, such as, for example, a mailing machine, often include different modules that automate the processes of producing articles, such as, for example, mail pieces. Mail pieces can include, for example, envelopes, post cards, flats, and the like. The typical mailing machine includes a variety of different modules or sub-systems each of which performs a different task on the mail piece. The mail piece is conveyed downstream utilizing a transport mechanism, such as rollers or a belt, to each of the modules. Such modules could include, for example, a separating module, i.e., separating a stack of mail pieces such that the mail pieces are conveyed one at a time along the transport path, a moistening/sealing module, i.e., wetting and closing the glued flap of an envelope, a weighing module, and a metering/printing module, i.e., applying evidence of postage to the mail piece. The exact configuration of the mailing machine is, of course, particular to the needs of the user.

One indicator customers use to evaluate and measure the performance of mailing machines is overall mailing machine throughput. Conventionally, throughput is defined as the number of mail pieces processed per minute. Typically, customers desire to process as many mail pieces per minute as possible. There are several factors that can limit the throughput of a mailing system.

For example, the computation of an indicium for each mail piece being processed takes time to complete. Typically, a control device, such as, for example, a microprocessor, performs user interface and controller functions for the mailing machine. Specifically, the control device provides all user interfaces, executes control of the mailing machine and print operations, calculates postage for debit based upon rate tables, provides the conduit for the Postal Security Device (PSD) to transfer postage indicia to the printer, operates with peripherals for accounting, printing and weighing, and conducts communications with a data center for postage funds refill, software download, rates download, and market-oriented data capture. The control device, in conjunction with an embedded PSD, provides the system meter that satisfies U.S. and international postal regulations regarding closed system information-based indicia postage meters. The requirements for an indicium for a closed system postage meter are defined in the "Performance Criteria for Information-Based Indicia and Security Architecture for Closed IBI Postage Metering System (PCIBI-C), dated Jan. 12, 1999. A closed system is a system whose basic components are dedicated to the production of information-based indicia and related functions, similar to an existing, traditional postage meter. A closed system, which may be a proprietary device used alone or in conjunction with other closely related, specialized equipment, includes the indicia print mechanism. The indicium consists of a two-dimensional (2D) barcode and certain human-readable information. Some of the data included in the barcode includes, for example, the PSD manufacturer identification, PSD model identification, PSD serial number, values for the ascending and descending registers of the PSD, postage amount, and date of mailing. In addition, a digital signature is required to be created by the PSD for each mail piece and placed in the digital signature field of the barcode. Several types of digital signature algorithms are supported by the IBIP, including, for example, the Digital Signature Algorithm (DSA), the Rivest Shamir Adleman (RSA) Algorithm, and the Elliptic Curve Digital Signature Algorithm (ECDSA).

Thus, for each mail piece the PSD must generate the indicium once the relevant data needed for the indicium generation is passed into the PSD and compute the digital signature to be included in the indicium. The generation of the indicia and computation of the digital signature requires a predetermined amount of time. For smaller mailing machines that do not have high throughput, the time delay associated with such generation and computation does not limit the throughput, i.e., the calculations are performed quickly enough and therefore are not a limiting factor for the throughput. For larger mailing machines with higher throughputs, however, the speed of processing the mail pieces may be limited by the time required for the PSD to perform its calculations in generating the digital signature and the indicium. Accordingly, the throughput of the mailing machine is confined due to the calculating time required by the PSD.

Another factor that can limit the throughput of a mailing system is related to the moistening/sealing function performed by a mailing system. Typically, a moistening/sealing module includes a structure for deflecting a flap of a moving mail piece away from the mail piece's body to enable the moistening and sealing process to occur. The deflecting structure typically includes a stripper blade that becomes inserted between the flap of the mail piece and the body of the mail piece as the mail piece traverses the transport deck of the mailing machine. Once the flap has been stripped, the moistening device moistens the glue line on the mail piece flap in preparation for sealing the mail piece. A contact moistening system generally deposits a moistening fluid, such as, for example, water or water with a biocide, onto the glue line on a flap of a mail piece by contacting the glue line with a wetted applicator. In contact systems, the wetted applicator typically consists of a contact media such as a brush, foam or felt. The applicator is in physical contact with a wick. The wick is generally a woven material, such as, for example, felt, or can also be a foam material. At least a portion of the wick is wetted with the moistening fluid from a reservoir. The moistening fluid is transferred from the wick to the applicator by physical contact pressure between the wick and applicator, thereby wetting the applicator. A stripped mail piece flap is guided between the wick and applicator, such that the applicator contacts the glue line on the flap of the mail piece, thereby transferring the moistening fluid to the flap to activate the glue. The flap is then closed and sealed, such as, for example, by passing the closed mail piece through a nip of a sealer roller to compress the mail piece and flap together, and the mail piece passed to the next module for continued processing.

Thus, since the moistening fluid is transferred from the applicator to the glue line of the mail piece flap as the mail piece flap passes between the applicator and wick, there must be sufficient time, referred to generally as replenishment time, between mail pieces to allow additional moistening fluid to be transferred from the wick to the applicator, thereby wetting the applicator, for moistening the subsequent mail piece. Insufficient replenishment time can result in an insufficient amount of moistening fluid being applied to the mail piece flaps, which can result in improper and inconsistent sealing of the mail pieces. To provide sufficient replenishment time, it is, therefore, necessary to provide a sufficient gap between mail pieces. Typically, the longer the mail piece, the greater the necessary replenishment time, which leads to a greater gap between mail pieces. As the gap size increases, the throughput of the mailing machine decreases.

Still another indicator customers use to evaluate and measure the performance of mailing machines is the ability to handle mail pieces of mixed sizes. This capability eliminates the need to presort the mail pieces into similar sized batches for processing. Since this presorting is often a manual task, a great deal of labor, time and expense is saved through mixed mail piece feeding. It is therefore necessary to provide a mailing system that can handle mixed mail while optimizing the throughput based on the processing time and replenishment constraints described above.

Some prior art systems seek to address these issues by feeding mail pieces at a fixed pitch. That is, the length of the mail piece plus its associated gap is always equal to a constant regardless of the size of the mail piece. Although these fixed pitch systems generally work well, they suffer from disadvantages and drawbacks. For example, the pitch must be set sufficiently large so as to accommodate the gap size required for moistening fluid applicator replenishment of the largest mail piece the system can process. However, as a result, when mail pieces shorter than the largest mail piece are being fed, the gap size is unnecessarily large and throughput efficiency is reduced.

Other prior art systems seek to address these issues by feeding mail pieces with a fixed gap regardless of the size of the mail piece. That is, the gap between mail pieces is constant regardless of the size of the mail pieces. Thus, in fixed gap systems, the pitch between subsequent mail pieces will vary depending upon the size of the first mail piece. Although these fixed gap systems generally work well, they also suffer from disadvantages and drawbacks. For example, the gap must be set sufficiently large so as to accommodate the size of the smallest mail piece while still providing the mailing system modules with a sufficient amount of time to perform its tasks, such as, for example, generation of an indicium. Thus, the size of the smallest mail piece taken along with the size of the gap cannot be so small so as to exceed the capabilities of the remainder of the mailing system. However, as a result, when larger articles are being fed, the constant gap may be unnecessarily large and throughput efficiency is reduced.

Still other prior art systems have addressed these issues by operating in a combination-of fixed pitch and fixed gap modes based on the determined length of the mail piece. Thus, if the mail piece is longer than a predetermined length, the mailing machine will operate in a fixed gap mode to allow sufficient replenishment time for the moistening fluid applicator, and if the mail piece is less than or equal to the predetermined length, the mailing machine will operate in a fixed pitch mode to allow sufficient time for generation of an indicium. While this type of system has worked well, there are still some limitations. For example, if the length of a mail piece exceeds the predetermined length, the gap between this mail piece and the next mail piece is still set to a fixed value regardless of the amount the length of the first mail piece exceeds the predetermined length. This fixed value is based on the moistening fluid applicator replenishment time required for the largest mail piece the system can process. Thus, for example, if the predetermined length is 9.5 inches, the gap is the same for a mail piece that is 10 inches long, 11 inches long, 12 inches long, or 13 inches long, even though the replenishment times required for each of these mail piece lengths is different and therefore require different size gaps.

Thus, there exists a need for a transport method and system that operates to feed mixed size mail pieces in singular fashion and adaptively controls the velocity of the mail pieces such that overall system performance is optimized.

SUMMARY OF THE INVENTION

The present invention alleviates the problems associated with the prior art and provides a transport method and system that operates to feed mixed size mail pieces in singular fashion and adaptively controls the velocity of the mail pieces such that overall system performance is optimized.

In accordance with the present invention, a mailing system is provided with a transport for transporting mail pieces through the mailing system. The length of a mail piece is measured and a desired gap time between the mail piece and a subsequent mail piece is calculated. The desired gap time is proportional to the measured length of the mail piece, and provides for optimal throughput while still being within the necessary functional constraints of the mailing machine. The gap time between the mail piece and the subsequent mail piece is measured, and a difference between the desired gap time and measured gap time is calculated. Based on the calculated gap time difference, the velocity of the subsequent mail piece is adaptively controlled to decrease the difference between the desired gap time and the measured gap time such that the measured gap time is adjusted to be approximately equal to the desired gap time, thereby optimizing throughput of the mailing system.

In accordance with one embodiment of the present invention, a dwell time during which the subsequent mail piece is transported at a selected dwell velocity is determined to correct the difference between the desired gap time and the measured gap time. The dwell velocity can be selected based upon the amount of difference between the desired gap time and measured gap time. The subsequent mail piece is transported at the selected dwell velocity for the determined dwell time, thereby decreasing the difference between the desired gap time and measured gap time. By controlling the measured gap time such that it is substantially equivalent to the desired gap time, the throughput efficiency of the mailing system can be optimized.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate a presently preferred embodiment of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
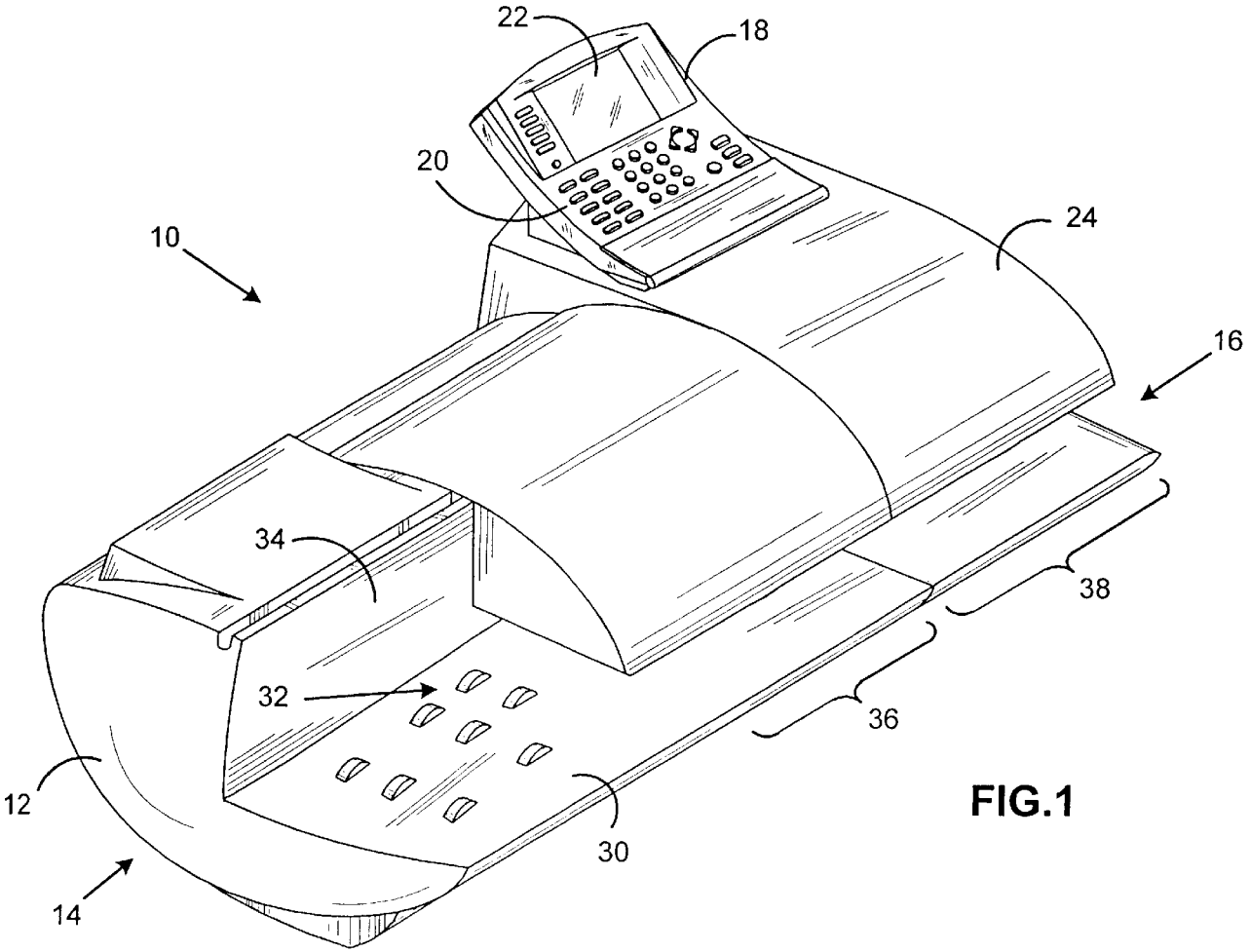
FIG. 1 illustrates a mailing machine having a transport method and system according to the present invention.

In describing the present invention, reference is made to the drawings, wherein there is seen in FIG. 1 a mailing machine 10 that utilizes a transport method and system according to the present invention. Mailing machine 10 comprises a base unit, designated generally by the reference numeral 12, the base unit 12 having a mail piece input end, designated generally by the reference numeral 14 and a mail piece output end, designated generally by the reference numeral 16. A control unit 18 is mounted on the base unit 12, and includes one or more input/output devices, such as, for example, a keyboard 20 and a display device 22. One or more cover members 24 are pivotally mounted on the base 12 so as to move from the closed position shown in FIG. 1 to an open position (not shown) so as to expose various operating components and parts for service and/or repair as needed.

Figure 2:
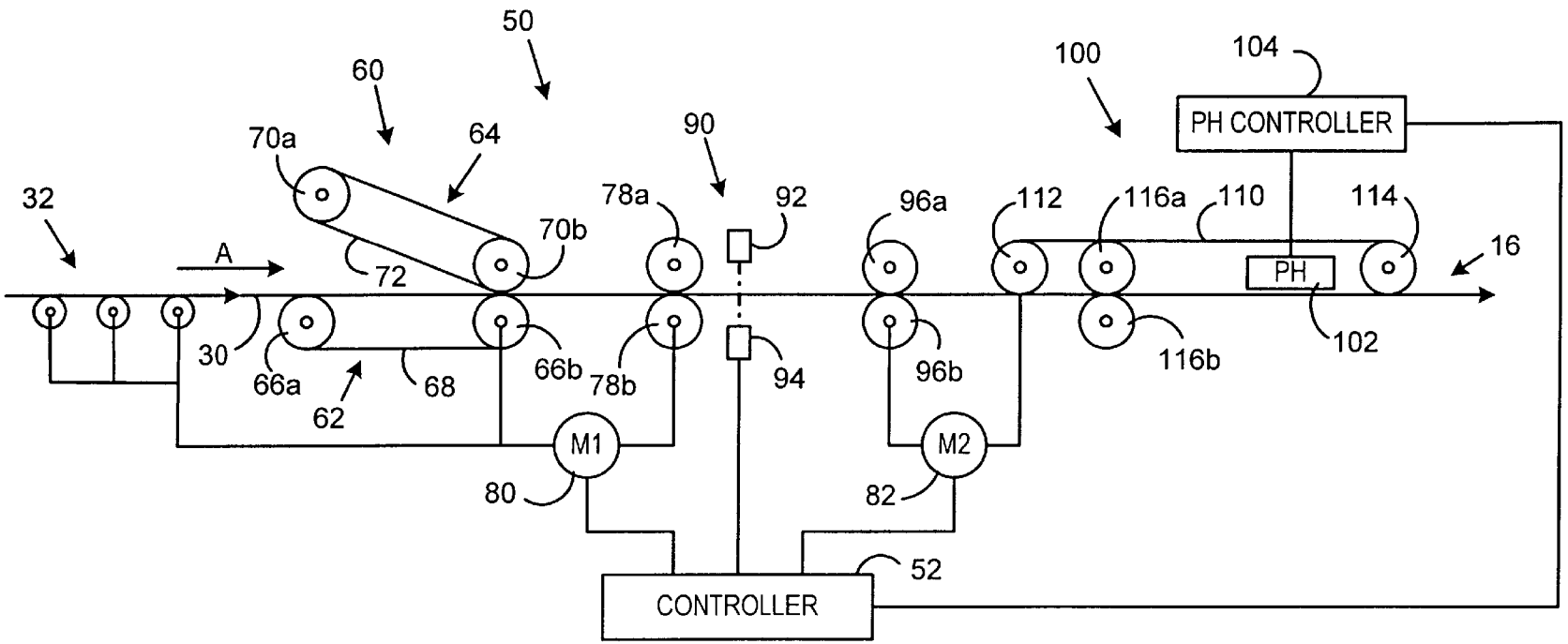
FIG. 2 illustrates a simplified schematic diagram of a transport system in accordance with the present invention.

The base unit 12 further includes a horizontal feed deck 30 which extends substantially from the input end 14 to the output end 16. A plurality of nudger rollers 32 are suitably mounted under the feed deck 30 and project upwardly through openings in the feed deck so that the periphery of the rollers 32 is slightly above the upper surface of the feed deck 30 and can exert a forward feeding force on a succession of mail pieces placed in the input end 14. A vertical wall 34 defines a mail piece stacking location from which the mail pieces are fed by the nudger rollers 32 along the feed deck 30 and into a transport system as illustrated in FIG. 2. The transport system (FIG. 2) transports the mail pieces through one or more modules, such as, for example, a separator module and moistening/sealing module. Each of these modules is located generally in the area indicated by reference numeral 36. The mail pieces are then passed to a metering/printing module located generally in the area indicated by reference numeral 38.

Referring now to FIG. 2, there is illustrated a simplified schematic diagram of a transport system, generally designated 50, in accordance with the present invention. Transport system 50 could be used, for example to transport a mail piece through the mailing machine 10 as illustrated in FIG. 1. Referring to FIG. 2, the operation and functioning of the transport system 50 is generally controlled by a controller 52. Controller 52 is coupled to a pair of motors M1 and M2, designated 80 and 82, respectively. Controller 52 is also coupled to a sensor module 90. A separator module 60 receives a stack of mail pieces (not shown) from nudger rollers 32 and separates and feeds them at variable speed in a seriatim fashion (one at a time) in a path of travel along the feed deck 30 as indicated by arrow A. Downstream from the path of travel, a conveyor apparatus 100 feeds the mail pieces at a constant speed in the path of travel along the deck 30 past a print head module 102 so that a postage indicia can be printed on each mail piece. The print head module 102 is of an ink jet print head type having a plurality of ink jet nozzles (not shown) for ejecting droplets of ink in response to appropriate signals from the print head controller 104, which is coupled to the controller 52. Sensors (not shown) within the conveyor apparatus 100 provide signals to the controller 52 indicating the position of a mail piece. Controller 52 then prompts the print head controller 104 to begin printing at the appropriate time when a mail piece is properly positioned.

The separator module 60 includes a feeder assembly 62 and a retard assembly 64 which work cooperatively to separate a batch of mail pieces (not shown) and feed them one at a time to a pair of take-away rollers 78*a,* 78*b*. The feeder assembly 62 includes a pair of rollers 66*a,* 66*b* and an endless belt 68 around them. The feeder assembly 60 is operatively connected to a motor M1 80 by any suitable drive train which causes the endless belt 68 to rotate clockwise so as to feed the envelopes in the direction indicated by arrow A. Motor 80 is also drives the nudger rollers 32. The retard assembly 64 includes a pair of rollers 70*a,* 70*b* having an endless belt 72 around them. The retard assembly 64 is operatively connected to any suitable drive means (not shown) which causes the endless belt 72 to rotate clockwise so as to prevent the upper mail pieces in the batch of mail pieces from reaching the take-away rollers 78*a,* 78*b*. In this manner, only the bottom mail piece in the stack of mail pieces advances to the take-away rollers 78*a,* 78*b*. Those skilled in the art will recognize that the retard assembly 64 may be operatively coupled to the same motor 80 as the feeder assembly 62.

Since the details of the separator module 60 are not necessary for an understanding of the present invention, no further description will be provided. However, an example of a separator module suitable for use in conjunction with the present invention is described in U.S. Pat. No. 4,978,114, entitled REVERSE BELT SINGULATING APPARATUS, the disclosure of which is specifically incorporated herein by reference.

The first set of take-away rollers 78*a,* 78*b* are located adjacent to and downstream in the path of travel from the separator module 60. The take-away rollers 78*a,* 78*b* are operatively connected to motor 80 by any suitable drive train (not shown). Generally, it is preferable to design the feeder assembly drive train and the take-away roller drive train so that the take-away rollers 78*a,* 78*b* operate at a higher speed than the feeder assembly 62. Thus, for example, motor 80 generates a velocity $V_1$ at the feeder assembly 62 and velocity $V_2$ at the take-away rollers 78*a,* 78*b,* where $V_2$ is greater than $V_1$. Preferably, the differential between $V_1$ and $V_2$ is not greater than 3%, thereby ensuring a smooth transition of mail pieces from the feeder assembly 62 to the take-away rollers 78*a,* 78*b.* Additionally, it is also preferable that the take-away rollers 78*a,* 78*b* have a very positive nip so that they dominate control over the mail piece. Consistent with this approach, the nip between the feeder assembly 62 and the retard assembly 64 is suitably designed to allow some degree of slippage.

The transport system 50 further includes a sensor module 90 which is downstream of take-away rollers 78*a,* 78*b.* Preferably, the sensor module 90 is of any conventional optical type which includes a light emitter 92 and a light detector 94. Generally, the light emitter 92 and the light detector 94 are located in opposed relationship on opposite sides of the path of travel so that the mail pieces pass between them. By measuring the amount of light that the light detector 94 receives, the presence or absence of a mail piece can be determined.

Generally, by detecting the leading and trailing edges of a mail piece, the sensor module 90 provides signals to the controller 52 which are used to determine the length of the mail piece that has just passed through the sensor module 90. The amount of time that passes between the lead edge detection and the trail edge detection, along with the speed at which the mail piece is being fed, can be used to determine the length of the mail piece. Additionally, the sensor module 90 measures the gap time between mail pieces by detecting the trailing edge of a first mail piece and the leading edge of a subsequent mail piece. Alternatively, an encoder system (not shown) can be used to measure the length of a mail piece by counting the number of encoder pulses which are directly related to a known amount of rotation of the take-away rollers 78*a,* 78*b.*

A second set of take-away rollers 96*a,* 96*b* are located downstream in the path of travel from the first set of take-away rollers 78*a,* 78*b.* The take-away rollers 96*a,* 96*b* are operatively connected to the motor 82 by any suitable drive train (not shown). Preferably, the moistening fluid applicator of a moistening system (not shown) is located between the take-away rollers 78*a,* 78*b* and take-away rollers 96*a,* 96*b.* Take-away rollers 96*a,* 96*b* can thus act as a sealing roller for the mail pieces to compress the moistened flap and body together for sealing. Generally, it is preferable to design the take-away roller assemblies such that the take-away rollers 96*a,* 96*b* operate at a higher speed than the take-away rollers 78*a,* 78*b.* Thus, for example, as noted above, if motor 80 generates a velocity $V_2$ at the take-rollers 78*a,* 78*b,* then motor 82 could generate a velocity $V_3$ at the take-away rollers 96*a,* 96*b,* where $V_3$ is greater than $V_2$. Preferably, the differential between $V_2$ and $V_3$ is not greater than 3%, thereby ensuring a smooth transition of mail pieces from the take-away rollers 78*a,* 78*b* to the take-away rollers 96*a,* 96*b.* Mail pieces are passed from the second set of take-away rollers 96*a,* 96*b* to the conveyor apparatus 100 for printing.

The conveyor apparatus 100 includes an endless belt 110 looped around a drive roller 112 and an encoder roller 114 which is located downstream in the path of travel from the drive roller 112 and proximate to the print head module 102. The drive roller 112 and the encoder roller 114 are substantially identical and are fixably mounted to respective shafts (not shown) which are in turn rotatively mounted to any suitable structure (not shown) such as a frame. The drive roller 112 is operatively connected to motor 82 by any conventional means such as intermeshing gears (not shown) or a timing belt (not shown) such that the speed of the endless belt is controlled by motor 82, via signals from the controller 52, to advance mail pieces past the print head module 102 for printing and out of the mailing machine 10 at the output end 16. The velocity of the conveyor apparatus 100 must be constant to ensure proper printing by the print head module 102, and preferably operates at a higher speed than the take-away rollers 96*a,* 96*b.* Thus, for example, as noted above, if motor 82 generates a velocity $V_3$ at the take-rollers 96*a,* 96*b,* then motor 82 could generate a velocity $V_4$ at the conveyor apparatus 100, where $V_4$ is greater than $V_3$. Preferably, the differential between $V_3$ and $V_4$ is not greater than 3%, thereby ensuring a smooth transition of mail pieces from the take-away rollers 96*a,* 96*b* to the conveyor apparatus 100. The velocity $V_4$ of the conveyor apparatus 100, may be, for example, set at 35 inches per second (ips). This value, of course, is dependent upon the characteristics and requirements of the print head module 102.

The conveyor apparatus 100 further includes a plurality of idler rollers 116*a* and a corresponding plurality of normal force rollers 116*b* (only one pair shown for clarity). The idler rollers 116*a* are rotatively mounted to any suitable structure (not shown) along the path of travel between the drive roller 112 and the encoder roller 114. The normal force rollers 116*b* are located in opposed relationship and biased toward the idler rollers 116*a.* The normal force rollers 116*b* work to bias the mail piece against a registration plate (not shown). This is commonly referred to as top surface registration which is beneficial for ink jet printing. Any variation in thickness of the mail piece is taken up by the deflection of the normal force rollers 116*b.* Thus, the distance between the print head module 102 and the top surface of the mail piece is constant regardless of the thickness of the mail piece. The distance is optimally set to a desired value to achieve quality printing.

It should be noted that the distance between the separator module 60 and take-away rollers 78*a,* 78*b,* between the take-away rollers 78*a,* 78*b* and take-away rollers 96*a,* 96*b,* and between take-away rollers 96*a,* 96*b* and conveyor apparatus 100, is such that the shortest mail piece being transported through the transport system 50 is always under positive control of at least one of these components. Thus, for example, if the shortest mail piece is 5 inches (127 mm) long, then the distance between any two adjacent components is preferably less than this value. For example, the distance between the separator module 60 and take-away rollers 78*a,* 78*b* could be approximately 80 mm, the distance between the take-away rollers 78*a,* 78*b* and take-away rollers 96*a,* 96*b* could be approximately 113 mm, and the distance between take-away rollers 96*a,* 96*b* and conveyor apparatus 100 could be approximately 54 mm. Thus, any mail piece that is being transported by the transport system 50 will always be under positive control of at least one of the separator module 60, the take-away rollers 78*a,* 78*b,* the take-away rollers 96*a,* 96*b,* or the conveyor apparatus 100.

As noted above, the speed of motors 80, 82, and thus the speed of the separator module 60, take-away rollers 78*a,* 78*b* and 96*a,* 96*b,* and conveyor apparatus 100 are controlled by the controller 52 which may be any suitable combination of hardware, firmware and software. Controller 52 may include one or more general processors or special purpose processors. In a preferred embodiment, the operation of the mailing machine 10, and thus the transport system 50, is optimized for handling #10 envelopes (9.5 inches long), which are the most prevalent for use in business mailings. The throughput of the mailing machine 10 can be, for example, 170 letters per minute (Ipm), not including any maintenance cycle for the print head module 102. It should be understood, of course, that the throughput is a matter of design choice and can be set at any desired limit within the constraints previously described. The throughput including the maintenance cycle will be slightly less. Mail pieces shorter than 9.5 inches must have the same throughput as #10 mail pieces to provide sufficient time for indicium generation, while mail pieces longer than 9.5 inches must have the maximum possible throughput within the constraints imposed by the replenishment time required for the moistening fluid applicator. Thus, in a preferred embodiment the transport system 50 is configured, i.e., velocities $V_1$, $V_2$, $V_3$ and $V_4$ are selected, such that when processing #10 envelopes (9.5 inches in length), a gap time of 50 msec is provided between mail pieces. This provides a sufficient replenishment time for the moistening fluid applicator for #10 envelopes. Thus, a natural gap of 50 msec is provided between all mail pieces at the beginning of the transport system 50. Longer mail pieces, however, must have a larger time gap, as more time is needed for replenishment, while shorter mail pieces must also have a larger gap time to maintain the same throughput requirement as #10 envelopes. Controller 52 performs an adaptive velocity control according to the present invention to adjust the gap time and create a desired gap between mail pieces as will be further described with respect to FIGS. 3–7.

Figure 3:
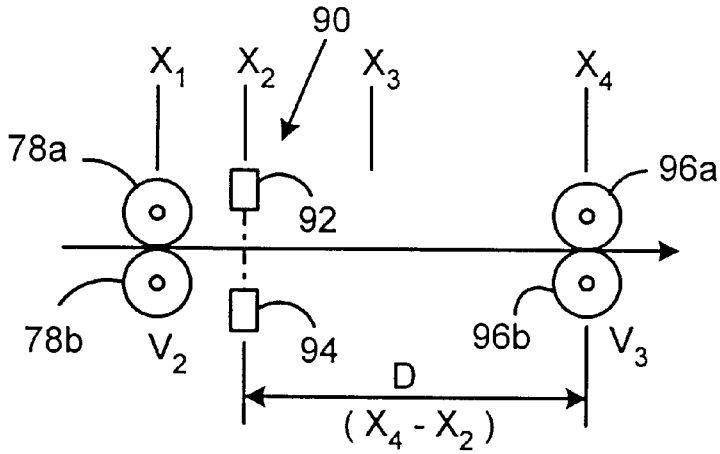
FIG. 3 illustrates a portion of the transport system shown in FIG. 2.
Figure 4:
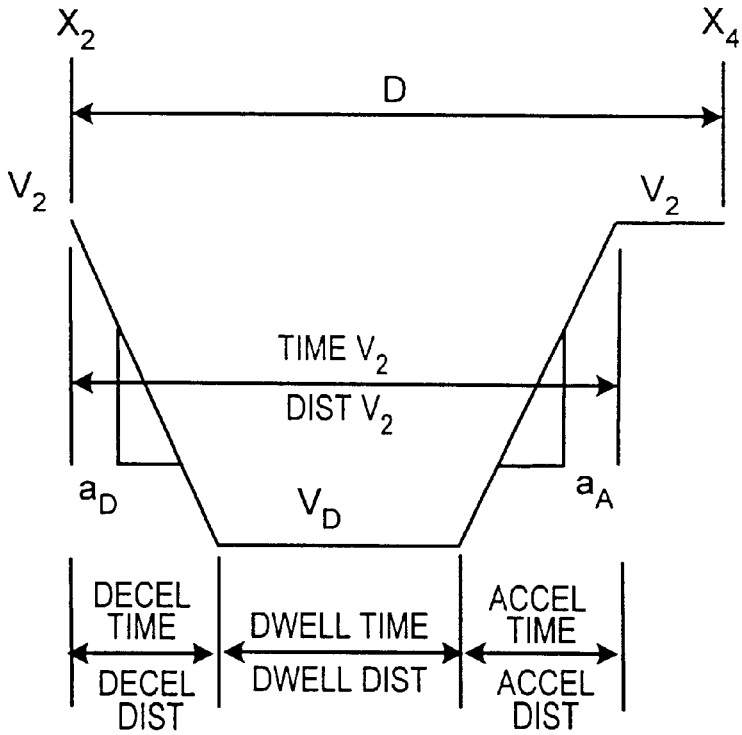
FIG. 4 illustrates an adaptive velocity control of a mail piece according to the present invention.

Referring now to FIG. 3, a portion of the transport system 50 is illustrated, and specifically the portion including the take-away rollers 78*a*, 78*b* and take-away rollers 96*a*, 96*b*. Preferably, the adaptive velocity control of the present invention occurs between the take-away rollers 78*a*, 78*b* and take-away rollers 96*a*, 96*b* as the speed of motor 80 can be regulated and this is the area where control of the mail piece transitions between motor 80 and motor 82. As illustrated in FIG. 3, the position of the take-away rollers 78*a*, 78*b* is designated $x_1$, the position of the sensor module 90 is designated $x_2$, and the position of the take-away rollers 96*a*, 96*b* is designated $x_4$. The position of a moistening fluid applicator is designated $x_3$, and is between $x_2$ and $x_4$. The velocity of take-away rollers 78*a*, 78*b* is nominally $V_2$, while the velocity of take-away rollers 96*a*, 96*b* is nominally $V_3$. The distance D between the sensor module 90 and take-away rollers 96*a*, 96*b*, defined as $x_4$-$x_2$, is the area in which the adaptive velocity control of the present invention preferably occurs. Preferably, a mail piece must be traveling at velocity $V_2$ before entering the take-away rollers 96*a*, 96*b* to ensure a smooth transition without any buckling or tearing of the mail piece. Thus, as illustrated in FIG. 4, the gap time between a fist mail piece and a subsequent second mail piece is adjusted utilizing an adaptive velocity control of the second mail piece according to the present invention that occurs in the distance D between the sensor module 90 and the take-away rollers 96*a*, 96*b*. This is performed by decelerating ($a_D$) the second mail piece for some time period, DecelTime, and some distance, DecelDist, to a dwell velocity $V_D$ for a determined period of time, DwellTime, and distance, DwellDist, and then accelerating ($a_A$) the second mail piece for some period of time, AccelTime, and distance, AccelDist, back to velocity $V_2$ before the second mail piece enters the take-away rollers 96*a*, 96*b*. Preferably, the decelaration, $a_D$, and acceleration, $a_A$, are not greater than 9.81 m/s$^2$ (386.22 ips$^2$).

Therefore, the dwell velocity, $V_D$, and the dwell time, DwellTime, are critical parameters in the control scheme of the present invention. If the kinematic relations are expressed clearly, a relation between these parameters can be found as follows. The time to adjust to make up for desired throughput can be expressed as:

$$AdjustTime=DesGapTime-MeasGapTime+TimeV_2 \tag{1}$$

This is expressed in terms of correction parameters as:

$$AdjustTime=DecelTime+DwellTime+AccelTime \tag{2}$$

Since equations (1) and (2) should be equal, $$DesGapTime-MeasGapTime+TimeV_2=DecelTime+DwellTime+AccelTime \tag{3}$$

If GapTimeDiff, an auxiliary variable, is defined as:

$$GapTimeDiff=DesGapTime-MeasGapTime \tag{4}$$

and other definitions as follows:

$$TimeV_2 = \frac{DistV_2}{V_2} \tag{5}$$

$$DistV_2=DecelDist+DwellDist+AccelDist \tag{6}$$

$$DecelTime = \frac{V_2 - V_D}{a_D} \tag{7}$$

$$AccelTime = \frac{V_2 - V_D}{a_A} \tag{8}$$

$$DecelDist = \frac{V_2^2 - V_D^2}{2a_D} \tag{9}$$

$$AccelDist = \frac{V_2^2 - V_D^2}{2a_A} \tag{10}$$

$$DwellDist=V_D \cdot DwellTime \tag{11}$$

then equation (3) can be rewritten using equation (4) and the other definitions as:

$$GapTimeDiff+TimeV_2=DecelTime+DwellTime+AccelTime \tag{12}$$

$$GapTimeDiff + \frac{DistV_2}{V_2} = \frac{V_2 - V_D}{a_D} + DwellTime + \frac{V_2 - V_D}{a_A} \tag{13}$$

$$GapTimeDiff + \frac{(DecelDist + DwellDist + AccelDist)}{V_2} = \frac{V_2 - V_D}{a_D} + DwellTime + \frac{V_2 - V_D}{a_A} \tag{14}$$

$$V_2 \cdot GapTimeDiff + DecelDist + DwellDist + AccelDist = \frac{V_2(V_2 - V_D)}{a_D} + V_2 \cdot DwellTime + \frac{V_2(V_2 - V_D)}{a_A} \tag{15}$$

$$V_2 \cdot GapTimeDiff + \frac{V_2^2 - V_D^2}{2a_D} + V_D \cdot DwellTime + \frac{V_2^2 - V_D^2}{2a_A} = \frac{V_2(V_2 - V_D)}{a_D} + V_2 \cdot DwellTime + \frac{V_2(V_2 - V_D)}{a_A} \tag{16}$$

$$V_2 \cdot GapTimeDiff + \frac{V_2^2 - V_D^2}{2a_D} + \frac{V_2^2 - V_D^2}{2a_A} - \frac{V_2(V_2 - V_D)}{a_D} - \frac{V_2(V_2 - V_D)}{a_A} = (V_2 - V_D) \cdot DwellTime \tag{17}$$

-continued $$V_2 \cdot GapTimeDiff + \frac{V_2^2 - V_D^2}{2a_D} + \frac{V_2^2 - V_D^2}{2a_A} - \frac{2V_2(V_2 - V_D)}{2a_D} - \frac{2V_2(V_2 - V_D)}{2a_A} = (V_2 - V_D) \cdot DwellTime \quad (18)$$

$$V_2 \cdot GapTimeDiff + \frac{V_2^2 - V_D^2 - 2V_2^2 + 2V_2V_D}{2a_D} + \frac{V_2^2 - V_D^2 - 2V_2^2 + 2V_2V_D}{2a_A} = (V_2 - V_D) \cdot DwellTime \quad (19)$$

$$V_2 \cdot GapTimeDiff + \frac{-V_2^2 + 2V_2V_D - V_D^2}{2a_D} + \frac{-V_2^2 + 2V_2V_D - V_D^2}{2a_A} = (V_2 - V_D) \cdot DwellTime \quad (20)$$

$$V_2 \cdot GapTimeDiff - \frac{(V_2 - V_D)^2}{2a_D} - \frac{(V_2 - V_D)^2}{2a_A} = (V_2 - V_D) \cdot DwellTime \quad (21)$$

$$\frac{V_2 \cdot GapTimeDiff}{(V_2 - V_D)} - \frac{(V_2 - V_D)}{2a_D} - \frac{(V_2 - V_D)}{2a_A} = DwellTime \quad (22)$$

$$DwellTime = \frac{V_2 \cdot GapTimeDiff}{(V_2 - V_D)} - (V_2 - V_D)\left[\frac{1}{2a_D} + \frac{1}{2a_A}\right] \quad (23)$$

$$DwellTime = \frac{V_2 \cdot GapTimeDiff}{(V_2 - V_D)} - (V_2 - V_D)\frac{(a_A + a_D)}{2a_A a_D} \quad (24)$$

If the case in which $a_D = a_A = a$ is considered, then equation (24) can be rewritten as:

$$DwellTime = \frac{V_2}{(V_2 - V_D)} \times GapTimeDiff - \frac{(V_2 - V_D)}{a} \quad (25)$$

Table 1 below describes the parameters used in the above equations (1)–(25).

TABLE 1

Parameters in control

| Parameter | Description | Unit |
|---|---|---|
| $V_D$ | Dwell velocity | ips |
| $a_D$ | Deceleration acceleration | $ips^2$ |
| $a_A$ | Acceleration acceleration | $ips^2$ |
| MeasGapTime | Actual measurement of gap time | msec |
| MeasLength | Actual measurement of mail length | in |
| DesGapTime | Desired gap time for specific mail piece length | msec |
| DecelTime | Time taken to decelerate from $V_2$ to $V_D$ | msec |
| DwellTime | Time taken @ $V_D$ | msec |
| AccelTime | Time taken to accelerate from $V_D$ to $V_2$ | msec |
| DecelDist | Distance taken to decelerate from $V_2$ to $V_D$ | in |
| DwellDist | Distance taken @ $V_D$ | in |
| AccelDist | Distance taken to accelerate from $V_D$ to $V_2$ | in |
| $TimeV_2$ | Time would be taken to travel @ $V_2$ in correction | msec |
| $DistV_2$ | Distance taken to travel in correction | in |
| AdjustTime | Time to adjust to make up for desired throughput | msec |
| GapTimeDiff | Difference between desired and measured gap | msec |

As noted above, $a_D = a_A = a = 9.81\ m/s^2$ (386.22 $ips^2$).

To determine the appropriate dwell time for a mail piece, it is therefore first necessary to determine the desired gap time required between the mail piece and the preceding mail piece. As noted above, the transport system 50 is configured such that when processing #10 envelopes (9.5 inches in length), a gap time of 50 msec is provided between mail pieces. This provides a sufficient replenishment time for the moistening fluid applicator. Longer mail pieces must have a larger time gap, as more time is needed for replenishment, while shorter mail pieces must also have a larger gap time to maintain the throughput requirement. If, for example, the mailing machine 10 is designed for a throughput of 170 Ipm for #10 envelopes, then the throughput for the longest mail piece that can be processed by mailing machine 10, such as, for example, flats having a length of 13 inches, would be around 100 Ipm. Mail pieces shorter than #10 envelopes should have the same throughput as #10 envelopes as discussed above. To accommodate all sizes of mail pieces, i.e., mixed mail, in the mailing machine 10 and to have smooth operation for uniform or mixed mail, it is desirable to have a linear progression of gaps depending on mail piece lengths. Thus, the gap between mail pieces will linearly increase for both shorter and longer mail pieces than #10 envelopes.

Figure 5:
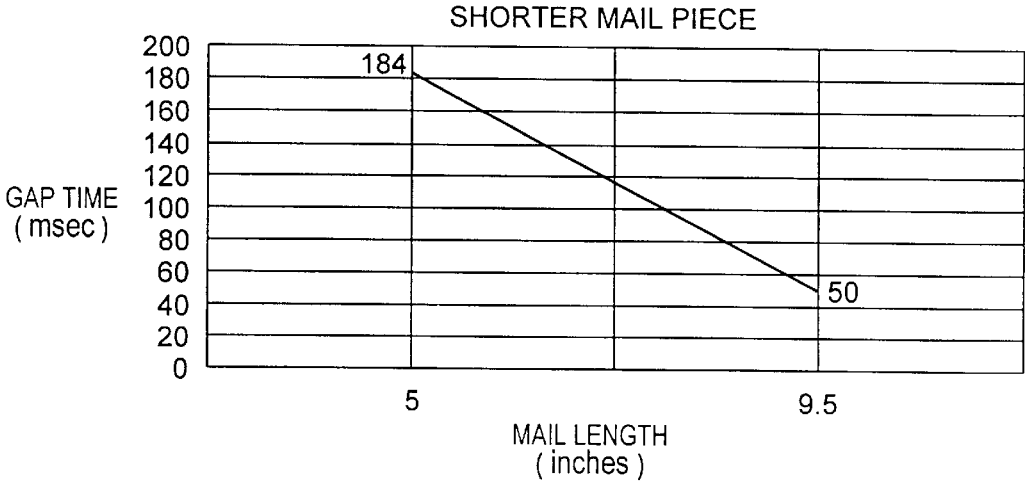
FIG. 5 illustrates a linear increase for gap time for shorter mail pieces according to an embodiment of the present invention.

FIG. 5 illustrates one example of a linear increase in gap time for mail pieces shorter than 9.5 inches as the length of the mail piece decreases from 9.5 inches to 5 inches. The throughput remains at 170 Ipm, with a cycle time of 353 msec per mail piece. Thus, for example, a mail piece that has a length of 9.5 inches has a gap time of 50 msec between it and the subsequent following mail piece (as noted above), but a mail piece that has a length of 5 inches requires a gap time of 184 msec between it and a subsequent following mail piece. The desired gap time will ensure that processing time of the mail piece is within the constraints imposed by the different modules of the mailing machine 10. The linear increase for shorter mail pieces results in the following relation for determining the desired gap time, DesGapTime, between a mail piece and a subsequent mail piece:

$$DesGapTime = m_{SHORT} \times MeasLength + C_{SHORT} \quad (26)$$

where the desired gap time is in milliseconds (msec), $m_{SHORT}$ and $C_{SHORT}$ are dependent upon the speed of response for the replenishment time of the moistening fluid applicator, and MeasLength is the measured length, in inches, of the first mail piece. For example, $m_{SHORT}$ could have a value of −29.71, and $C_{SHORT}$ could have a value of 332.24.

Figure 6:
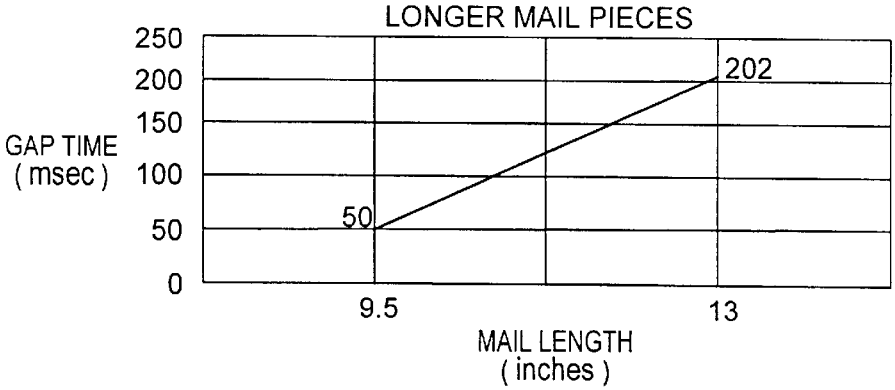
FIG. 6 illustrates a linear increase for gap time for longer mail pieces according to an embodiment of the present invention.

FIG. 6 illustrates one example of a linear increase in gap time for a mail piece longer than 9.5 inches as the length of the mail piece increases from 9.5 inches to 13 inches, with a throughput of 100 Ipm for 13 inch mail pieces. The cycle time for 13 inch mail pieces is 600 msec. Thus, for example, a mail piece that has a length of 9.5 inches has the gap time of 50 msec between it and the subsequent following mail piece (as noted above), but a mail piece that has a length of 13 inches requires a gap time of 202 msec between it and a subsequent following mail piece. The linear increase for longer mail pieces results in the following relation for determining the desired gap time, DesGapTime, between a mail piece and a subsequent mail piece:

$$DesGapTime = m_{LONG} \times MeasLength + C_{LONG} \quad (27)$$

where the desired gap time is in milliseconds (msec), $m_{LONG}$ and $C_{LONG}$ are dependent upon the speed of response for the replenishment time of the moistening fluid applicator, and MeasLength is the measured length, in inches, of the first mail piece. For example, $m_{LONG}$ could have a value of 43.35, and $C_{LONG}$ could have a value of 361.80. As illustrated in Equations (26) and (27) above, the desired gap time that follows a mail piece is directly proportional to the measured length of the mail piece for all mail piece lengths.

Figure 7:
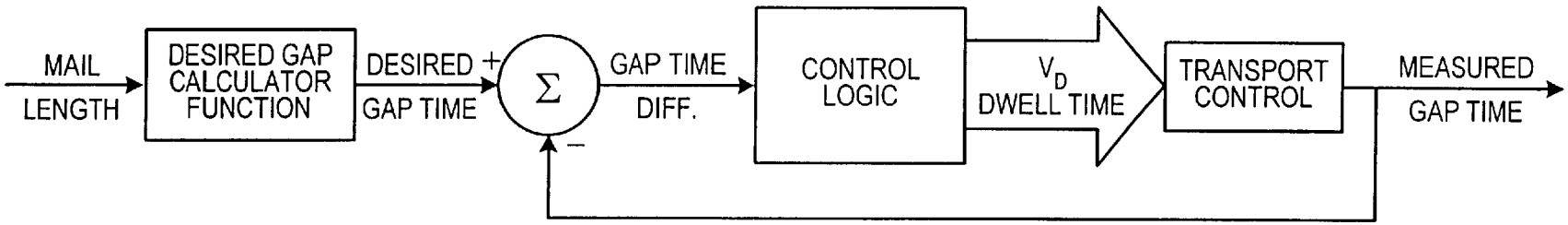
FIG. 7 illustrates in block diagram form the closed-loop control approach of the present invention.

The control system of the present invention is a heuristic closed-loop control approach as illustrated in FIG. 7. As illustrated in FIG. 7, once the length of a mail piece is measured, utilizing sensor module 90 as described above, the desired gap time, DesGapTime, to follow the mail piece can be calculated using either equation (26) or (27) above, depending upon the measured length of the mail piece. The actual gap time between the mail piece and a subsequent mail piece, MeasGapTime, is also determined, utilizing sensor module 90 as described above, and thus the gap time difference variable (GapTimeDiff) can be calculated using equation (4) above. Utilizing the calculated gap time difference, a suitable dwell velocity, $V_D$, can be selected by control logic, e.g., controller 52, and applied to the appropriate portion of the transport control, i.e., motor 80, to provide a dwell time, DwellTime, for the subsequent mail piece that will correct the measured gap time to be equal to the desired gap time, utilizing the relationship given in equation (25) above.

It should be noted that there are some constraints imposed upon the variables in equation (25) above. For example, the dwell time, DwellTime, is preferably greater than some minimum amount, such as, for example, 4 msec, since any difference between the desired gap time and measured gap time of less than 4 msec is substantially inconsequential and may not be able to be adjusted any further due to electromechanical limitations of the transport system 50. In addition, the distance traveled during the gap correction ($DistV_2$ in FIG. 4) is preferably less than the maximum distance allowed for correction, $D_c$. For example, the maximum distance allowed for correction will be slightly less than the distance D illustrated in FIG. 4, due to the delay associated with sensor module 90 and the small distance just before the take-away rollers 96*a,* 96*b* (at position $x_4$ in FIG. 4) when the mail piece should be returned to velocity $V_2$. These constraints will impact the selection of the dwell velocity, $V^D$, utilized to implement the correction. Additionally, as previously noted, the deceleration, $a_D$, and acceleration, $a_A$, is preferably less than or equal to gravitational acceleration, G, i.e., 9.81 m/s$^2$ (386.22 ips$^2$). Additionally, $V_2$ should be greater than $V_D$ which should be greater than or equal to zero. Furthermore, the correction of the measured gap time should occur only for mail pieces having a different length than #10 envelopes, i.e., 9.5 inches. Therefore, there is preferably a defined tolerance to cover measurement errors when measuring the length of a mail piece that indicates a safe operation bandwidth for #10 envelopes. For example, the measurement tolerance could be ±0.3 inches.

Figure 8:
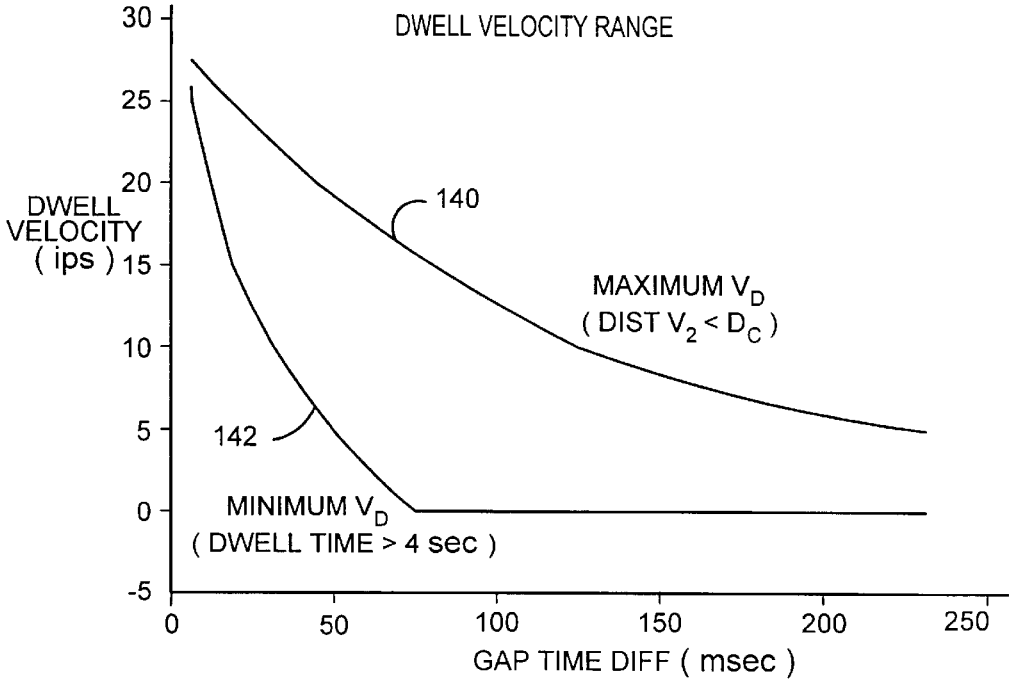
FIG. 8 illustrates an example of a dwell velocity range for the adaptive velocity control of a mail piece according to the present invention.

An exemplary selection process of a dwell velocity, $V_D$, will now be described with respect to FIG. 8, which illustrates one example of a range between a maximum dwell velocity curve, Maximum $V_D$, generally designated by reference numeral 140, and a minimum dwell velocity curve, Minimum $V_D$, generally designated by the reference numeral 142. This range can be selected as a function of the difference between the desired and measured gap time, GapTime Diff, using the above constraints. As shown, the maximum dwell velocity curve, Maximum $V_D$, 140 is constrained based on the distance traveled during the gap correction, $DistV_2$, being less than the maximum distance allowed for correction, $D_C$. Thus, the area above the maximum dwell velocity curve 140 results in this constraint being violated and is not valid. The minimum dwell velocity curve, Minimum $V_D$, 142 is constrained based on the dwell time, DwellTime, being greater than 4 msec. Thus, the area below the minimum dwell velocity curve 142 results in this constraint being violated and is not valid. It should be noted that the area between the maximum dwell velocity curve 140 and minimum dwell velocity curve 142, i.e., the feasible area for the dwell velocity $V_D$, is dependent upon the possible acceleration and deceleration values. Basically, the greater the acceleration and deceleration values, the larger the feasible area. If a dwell velocity, $V_D$, is selected between the maximum dwell velocity curve 140 and minimum dwell velocity curve 142, it will be within the above constraints and the dwell time, DwellTime, can then be calculated using equation (25) above. It should be understood that the curves illustrated in FIG. 8 are exemplary in nature, as they are based on several parameters dictated by the characteristics of the mailing machine. Therefore, the values illustrated are not limiting on the present invention.

As can be seen from FIG. 8, the selection of only a single discrete dwell velocity $V_D$ for use in determining the dwell time may not be sufficient for all values of GapTimeDiff. For example, for a dwell velocity, $V_D$, of 12 ips, any value of GapTimeDiff that exceeds approximately 110 msec is above the maximum dwell velocity curve 140 for this dwell velocity and therefore is not valid, as the distance traveled during correction, $DistV_2$, would be greater than the maximum distance allowed for correction, $D_C$, and the correction would not be sufficient. Thus, the measured gap would never reach the desired gap between the mail pieces. The same problem is encountered for any single discrete dwell velocity, $V_D$, utilized to calculate the dwell time. To overcome this problem, it is possible to use two discrete dwell velocities, $V_D$, to cover a reasonable range of values for GapTimeDiff. For example, selecting two dwell velocities of 7 ips and 18.3 ips will cover the range of 47 msec and greater GapTimeDiff and between 12 and 47 msec GapTimeDiff, respectively. However, any value of GapTimeDiff that is less than 12 msec is below the minimum dwell velocity curve 142 for either of these dwell velocities and therefore is not valid, as it would result in a dwell time, DwellTime, less than 4 msec.

Figure 9:
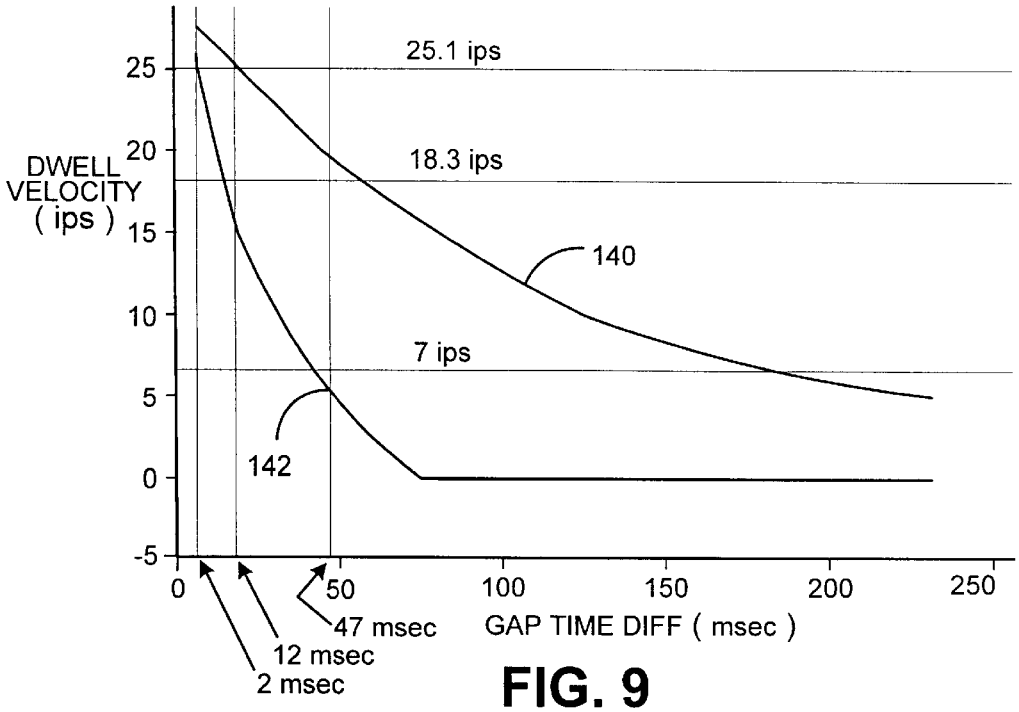
FIG. 9 illustrates three discrete dwell velocities within the dwell velocity range of FIG. 8 according to an embodiment of the present invention.

To cover almost the entire range of values for GapTimeDiff, three discrete dwell velocities can be selected according to another embodiment as illustrated in FIG. 9. Thus, for example, in addition to dwell velocities of 7 ips and 18.3 ips, a third dwell velocity of 25.1 ips is selected to cover the range of 2 msec to 12 msec. Thus, any value for GapTimeDiff of 2 msec or greater is covered by the selection of one of these three dwell velocities. For example, if the value for GapTimeDiff exceeds a threshold of 47 msec, 7 ips will be selected as the dwell velocity, $V_D$; if the value for GapTimeDiff is less than a threshold of 12 msec, 25.1 ips will be selected as the dwell velocity, $V_D$; and if the value for GapTimeDiff is between or includes the threshold values of 12 msec and 47 msec, 18.3 ips will be selected as the dwell velocity, $V_D$. It should be understood, of course, that these values are exemplary only, and the actual values selected may be different dependent upon the characteristics of the mailing machine utilizing the present invention. Recall that any difference between the desired gap time and measured gap time of less than 4 msec need not be corrected.

Once a suitable dwell velocity, $V_D$, has been selected, equation (25) above can be utilized to provide a dwell time, DwellTime, for the subsequent mail piece that will correct the measured gap time to be substantially equal to the desired gap time. Controller 52 will utilize the dwell velocity, $V_D$, and dwell time to control the motor 80, thereby regulating the speed of the subsequent mail piece such that the desired gap time will substantially be achieved.

Thus, according to the present invention, a transport method and system is provided that operates to feed mixed size mail pieces in singular fashion and adaptively controls the velocity of the mail pieces such that overall system performance is optimized. The length of a mail piece is measured and a desired gap time between the mail piece and a subsequent mail piece is calculated. The gap time between the mail piece and the subsequent mail piece is measured, and a difference between the desired gap time and measured gap time is calculated. Based on the calculated gap time difference, the velocity of the subsequent mail piece is adaptively controlled to decrease the difference between the desired gap time and the measured gap time such that the measured gap time is adjusted to be approximately equal to the desired gap time, thereby optimizing throughput of the mailing system. A dwell time during which the subsequent mail piece is transported at a selected dwell velocity is determined to correct the difference between the desired gap time and the measured gap time. A dwell velocity can be selected based upon the amount of difference between the desired gap time and measured gap time. The subsequent mail piece is transported at the dwell velocity for the determined dwell time, thereby decreasing the difference between the desired gap time and measured gap time.

Figure 10A:
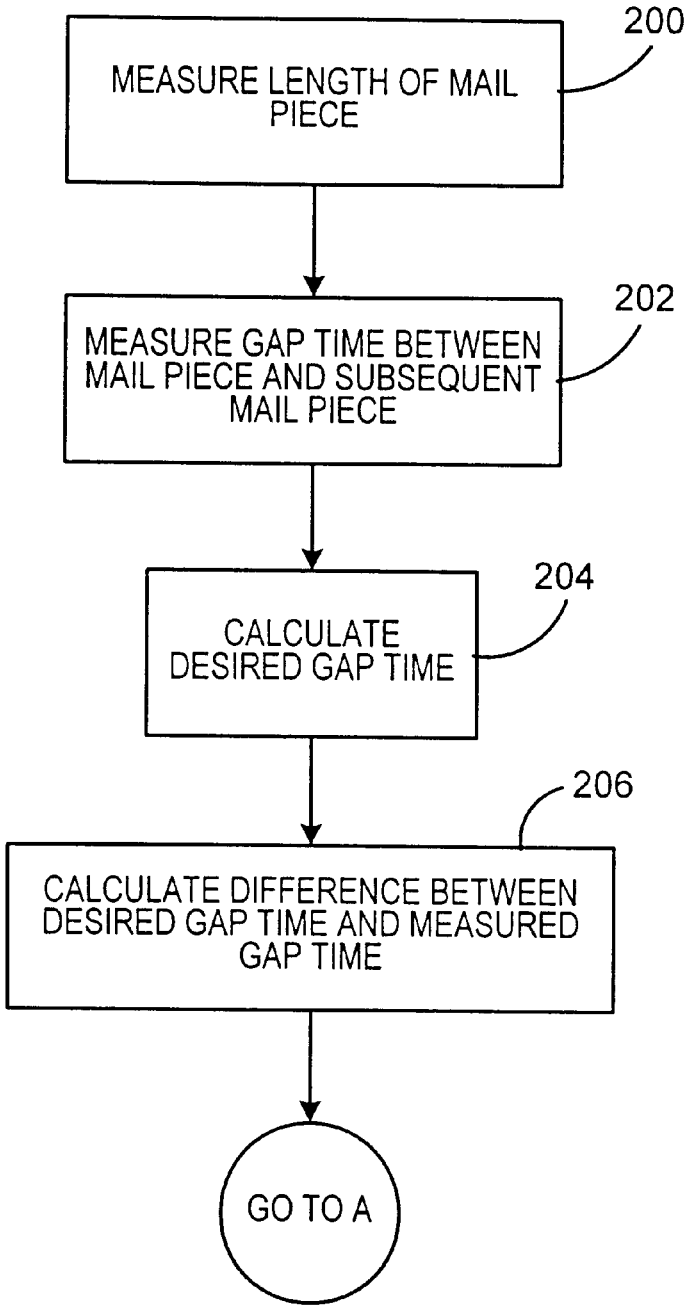
FIGS. 10A and 10B illustrate in flow diagram form the adaptive velocity control according to an embodiment of the present invention utilizing the three dwell velocities illustrated in FIG. 9.
Figure 10B:
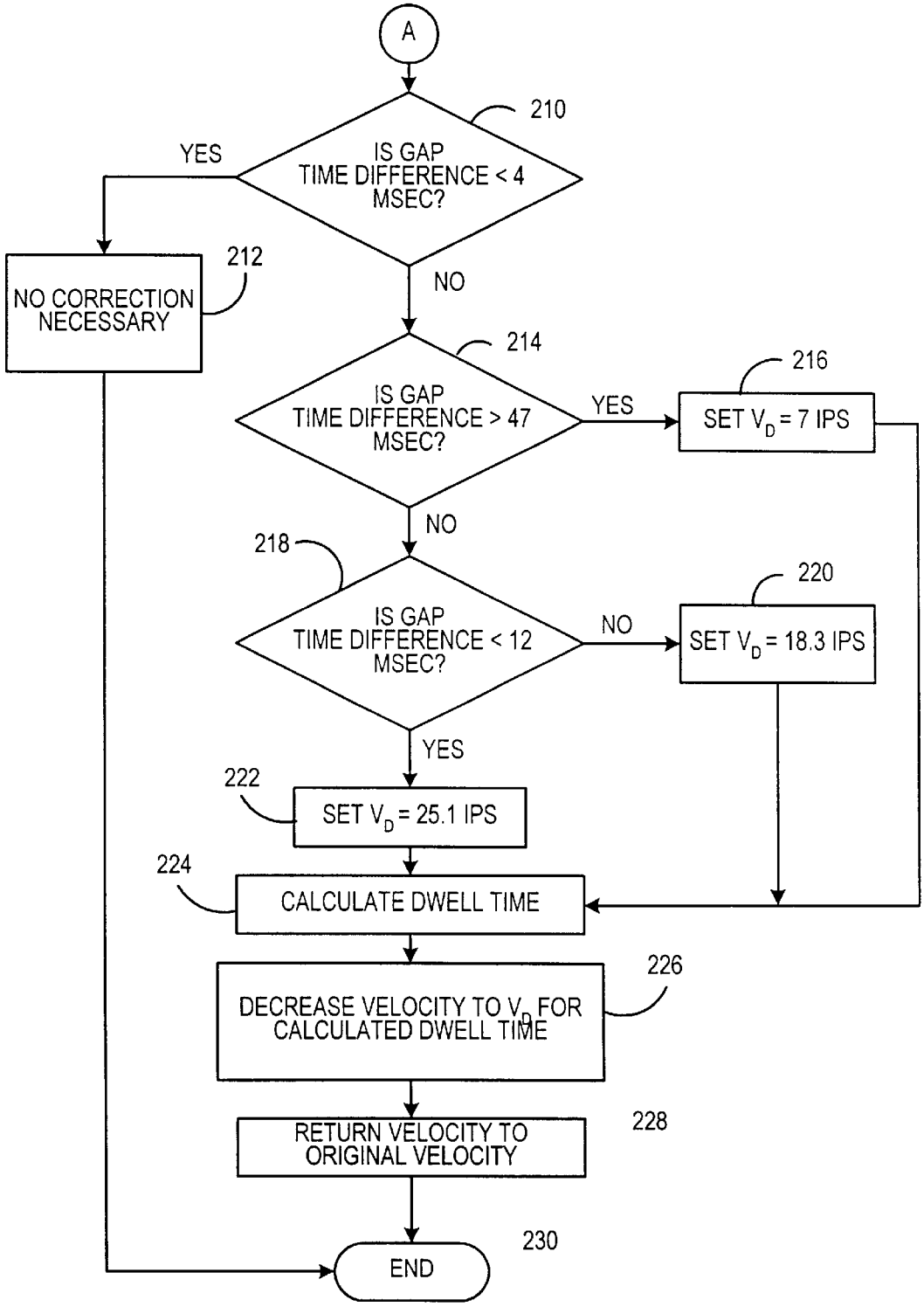

Referring now to FIGS. 10A and 10B, there is illustrated in flow diagram form the adaptive velocity control according to an embodiment of the present invention that utilizes the three dwell velocities illustrated in FIG. 9. The description of FIGS. 10A and 10B will be made with respect to the transport system 50 illustrated in FIG. 2. In step 200, the length of a mail piece, hereinafter referred to as the first mail piece, is measured. This can be performed, for example, by controller 52 utilizing the sensor module 90 to detect the leading and trailing edge of the first mail piece. In step 202, the gap time between the first mail piece (whose length was just measured) and a subsequent mail piece, hereinafter referred to as the second mail piece, is measured. This also can be performed, for example, by controller 52 utilizing the sensor module 90 to detect the trailing edge of the first mail piece and the leading edge of the second mail piece. In step 204, the desired gap time between the first mail piece and the second mail piece is calculated utilizing either equation (26) or (27). If the length of the first mail piece is less than 9.5 inches, equation (26) will be used. If the length of the first mail piece is greater than 9.5 inches, equation (27) will be used. If the length of the first mail piece is equal to 9.5 inches, either equation (26) or (27) can be used, as the desired gap time utilizing either equation will be calculated as 50 msec. The calculation can be performed, for example, by controller 52. Alternatively, instead of performing a calculation for the desire gap time, a look up table can be employed that provides a corresponding desired gap time for different lengths of mail pieces.

Once the desired gap time has been calculated or determined, then in step 206 the difference between the desired gap time and the measured gap time (from step 202) is determined utilizing equation (4) above. This difference can be determined, for example, by controller 52.

Referring now to FIG. 10B, in step 210, it is determined if the gap time difference calculated in step 206 is less than 4 msec. If the gap time difference is less than 4 msec, then in step 212 it is determined that no correction of the measured gap is necessary and the adaptive velocity control process ends in step 230. If the gap time difference is greater than 4 msec, then in step 214 it is determined if the gap time difference is greater than 47 msec. If the gap time difference is greater than 47 msec, then in step 216 the dwell velocity, $V_D$, is set to 7 ips, and the processing proceeds to step 224 (described below). If the gap time difference is not greater than 47 msec, then in step 218 it is determined if the gap time difference is less than 12 msec. If the gap time difference is not less than 12 msec, then in step 220 the dwell velocity, $V_D$, is set to 18.3 ips, and the processing proceeds to step 224 (described below). If it is determined that the gap time difference is less than 12 msec, then in step 222 the dwell velocity, $V_D$, is set to 25.1 ips, and the processing proceeds to step 224.

Once a dwell velocity, $V_D$, has been set, either in step 216, 220, or 222, then in step 224 the dwell time, DwellTime, is calculated using equation (25) above. Once the dwell time has been calculated, the controller 52 knows the velocity control that must be performed on the second mail piece to adjust the gap between the first and second mail piece to the desired gap size. Thus, in step 226, the velocity of the second mail piece is reduced to the selected dwell velocity, $V_D$, via the motor 80 and take-away rollers 78*a,* 78*b* (as the second mail piece is still under the control of take-away rollers 78*a,* 78*b*) and run at the dwell velocity, $V_D$, for the calculated dwell time. In step 228, the velocity of the second mail piece is returned to the original velocity. Preferably, the second mail piece is returned to its original velocity before it enters the take-away rollers 96*a,* 96*b,* thereby ensuring a smooth transition between the take-away rollers 78*a,* 78*b* and take-away rollers 96*a,* 96*b.* This is shown in FIG. 4, wherein the velocity is decelerated from its nominal velocity, $V_2$, at the take-away rollers 78*a,* 78*b,* to the selected dwell velocity, $V_D$, for the calculated dwell time, DwellTime, and then accelerated back to velocity $V_2$ before entering the take-away rollers 96*a,* 96*b.* The adaptive velocity control process then ends in step 230.

Thus, by adaptively controlling the velocity of the second mail piece, the desired gap time can be achieved between the first mail piece and the second mail piece, thereby optimizing the throughput efficiency of the mailing machine 10. The gap time between successive mail pieces will be minimized based on the length of the first mail piece, thereby providing significant time savings as compared to conventional fixed gap or fixed pitch control systems. Those skilled in the art will also recognize that various modifications can be made without departing from the spirit of the present invention. For example, the dwell velocity could be calculated such that it is always on or very close to the maximum dwell velocity curve 140 (FIG. 8). This could be done, for example utilizing an exact function fit to obtain a formula for calculating the dwell velocity based on the difference between the desired gap time and the measured gap time. The formula could be an exponential or quadratic formula. Of course, this requires significant processing and may be computationally inefficient to implement. As another example, the dwell velocity can be selected via a piecewise linear function fit. A look-up table can be utilized to determine a particular dwell velocity specific for the difference between the desired gap and measured gap. Each dwell velocity is provided with a corresponding dwell time, such that it is not necessary to calculate the dwell time for each dwell velocity.

Additionally, it should be noted that while the present invention was described with respect to mail pieces, the present invention is not so limited and can be utilized for transporting any type of articles where it is desired to optimize the throughput efficiency while maintaining sufficient gaps between articles.

While preferred embodiments of the invention have been described and illustrated above, it should be understood that they are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A method of transporting articles comprising:

determining a length of a first article;

obtaining a desired gap time between the first article and a second article, the desired gap time being proportional to the length of the first article; and controlling a velocity of the second article such that a gap between the first article and the second article is substantially equal to the desired gap time between the first article and the second article, wherein controlling the velocity of the second article further comprises:

measuring a gap time between the first article and the second article;

calculating a difference between the desired gap time and the measured gap time;

determining a dwell velocity based on the difference between the desired gap time and the measured gap time; and moving the second article at the dwell velocity.

2. The method of claim 1, wherein obtaining a desired gap time further comprises:

calculating the desired gap time based on the length of the first article.

3. The method of claim 1, wherein obtaining a desired gap time further comprises:

using a look-up table to obtain the desired gap time based on the length of the first article.

4. The method of claim 1, wherein determining a dwell velocity further comprises:

selecting a dwell velocity from a range of dwell velocities.

5. The method of claim 4, wherein selecting a dwell velocity further comprises:

selecting a dwell velocity from the range of dwell velocities based on an amount of the difference between the desired gap time and the measured gap time.

6. The method of claim 5, wherein selecting a dwell velocity further comprises:

selecting a first dwell velocity if the difference between the desired gap time and the measured gap time is greater than a first predetermined threshold;

selecting a second dwell velocity if the difference between the desired gap time and the measured gap time is less than a second predetermined threshold; and selecting a third dwell velocity if the difference between the desired gap time and the measured gap time is not greater then the first predetermined threshold and not less than the second predetermined threshold.

7. The method of claim 1, wherein determining a dwell velocity further comprises:

calculating a dwell velocity based on the difference between the desired gap time and the measured gap time.

8. The method of claim 1, wherein determining a dwell velocity further comprises:

using a look-up table to determine a dwell velocity.

9. The method of claim 8, wherein the dwell velocity has a corresponding dwell time; and moving the second article at the dwell velocity further comprises:

moving the second article at the dwell velocity for the corresponding dwell time.

10. The method of claim 9, wherein moving the second article further comprises:

decelerating the second article from a first velocity to the dwell velocity;

moving the second article at the dwell velocity for the dwell time; and accelerating the second article back to the first velocity.

11. The method of claim 1, wherein moving the second article at the dwell velocity further comprises:

calculating a dwell time based on the dwell velocity; and moving the second article at the dwell velocity for the dwell time.

12. The method of claim 11, wherein moving the second article further comprises:

decelerating the second article from a first velocity to the dwell velocity;

moving the second article at the dwell velocity for the dwell time; and accelerating the second article back to the first velocity.

13. The method of claim 1, wherein the first and second articles are mail pieces.

14. The method of claim 1, wherein controlling a velocity further comprises:

decreasing the velocity of the second article from a first velocity to a second velocity; and increasing the velocity from the second velocity back to the first velocity.

15. A method of transporting mail pieces in a mailing system comprising:

measuring a length of a first mail piece;

measuring a gap time between the first mail piece and a second mail piece;

determining a desired gap time between the first mail piece and the second mail piece;

determining a difference between the desired gap time and the measured gap time;

selecting a dwell velocity based on the difference between the desired gap time and the measured gap time;

determining a dwell time based on the selected dwell velocity; and moving the second mail piece at the selected dwell velocity for the dwell time such that the gap time between the first mail piece and the second mail piece will be substantially equal to the desired gap time between the first mail piece and the second mail piece.

16. The method of claim 15, wherein determining a desired gap time further comprises:

calculating the desired gap time based on the length of the first mail piece.

17. The method of claim 15, wherein determining a desired gap time further comprises:

using a look-up table to obtain the desired gap time based on the length of the first mail piece.

18. The method of claim 15, wherein selecting a dwell velocity further comprises:

selecting a dwell velocity from a range of dwell velocities based on an amount of the difference between the desired gap time and the measured gap time.

19. The method of claim 18, wherein selecting a dwell velocity further comprises:

selecting a first dwell velocity if the difference between the desired gap time and the measured gap time is greater than a first predetermined threshold;

selecting a second dwell velocity if the difference between the desired gap time and the measured gap time is less than a second predetermined threshold; and selecting a third dwell velocity if the difference between the desired gap time and the measured gap time is not greater then the first predetermined threshold and not less than the second predetermined threshold.

20. The method of claim 15, wherein selecting a dwell velocity further comprises:

calculating a dwell velocity based on the difference between the desired gap time and the measured gap time.

21. The method of claim 15, wherein selecting a dwell velocity further comprises:

using a look-up table to select a dwell velocity.

22. The method of claim 21, wherein determining a dwell time further comprises:

obtaining a corresponding dwell time from the look-up table for the selected dwell velocity.

23. The method of claim 15, wherein determining a dwell time further comprises;

calculating a dwell time based on the dwell velocity.

24. The method of claim 15, wherein moving the second mail piece at the selected dwell velocity further comprises:

decelerating the second mail piece from a first velocity to the dwell velocity; and accelerating the second mail piece back to the first velocity.

25. The method of claim 15, wherein the desired gap time is proportional to the length of the first mail piece.

26. A transport system for articles comprising:

means for determining a length of a first article;

means for obtaining a desired gap time between the first article and a second article, the desired gap time being proportional to the length of the first article; and means for controlling a velocity of the second article such that a gap between the first article and the second article is substantially equal to the desired gap time between the first article and the second article, wherein the means for controlling the velocity of the second article further comprises:

means for measuring a gap time between the first article and the second article;

means for calculating a difference between the desired gap time and the measured gap time;

means for determining a dwell velocity based on the difference between the desired gap time and the measured gap time; and means for moving the second article at the dwell velocity.

27. The transport system of claim 26, wherein the means for obtaining a desired gap time further comprises:

means for calculating the desired gap time based on the length of the first article.

28. The transport system of claim 26, wherein the means for obtaining a desired gap time further comprises:

a look-up table utilized to obtain the desired gap time based on the length of the first article.

29. The transport system of claim 26, wherein the means for determining a dwell velocity further comprises:

means for selecting a dwell velocity from a range of dwell velocities.

30. The transport system of claim 29, wherein the means for selecting a dwell velocity further comprises:

means for selecting a dwell velocity from the range of dwell velocities based on an amount of the difference between the desired gap time and the measured gap time.

31. The transport system of claim 30, wherein the means for selecting a dwell velocity further comprises:

means for selecting one of a first dwell velocity, a second dwell velocity, or a third dwell velocity, the first dwell velocity being selected if the difference between the desired gap time and the measured gap time is greater than a first predetermined threshold, the second dwell velocity being selected if the difference between the desired gap time and the measured gap time is less than a second predetermined threshold, and the third dwell velocity being selected if the difference between the desired gap time and the measured gap time is not greater then the first predetermined threshold and not less than the second predetermined threshold.

32. The transport system of claim 26, wherein the means for determining a dwell velocity further comprises:

means for calculating a dwell velocity based on the difference between the desired gap time and the measured gap time.

33. The transport system of claim 26, wherein the means for determining a dwell velocity further comprises:

a look-up table utilized to determine a dwell velocity.

34. The transport system of claim 33, wherein the dwell velocity has a corresponding dwell time, and the second article is moved at the dwell velocity for the corresponding dwell time.

35. The transport system of claim 34, wherein the means for moving the second article further comprises:

means for decelerating the second article from a first velocity to the dwell velocity for the dwell time; and means for accelerating the second article back to the first velocity.

36. The transport system of claim 26, wherein the means for moving the second article at the dwell velocity further comprises:

means for calculating a dwell time based on the dwell velocity; and means for moving the second article at the dwell velocity for the dwell time.

37. The transport system of claim 36, wherein the means for moving the second article further comprises:

means for decelerating the second article from a first velocity to the dwell velocity for the dwell time; and means for accelerating the second article back to the first velocity.

38. The transport system of claim 26, wherein the means for controlling a velocity further comprises:

means for decreasing the velocity of the second article from a first velocity to a second velocity; and means for increasing the velocity from the second velocity back to the first velocity.

39. A transport system for a mailing machine, the transport system comprising:

means for measuring a length of a first mail piece;

means for measuring a gap time between the first mail piece and a second mail piece;

means for determining a desired gap time between the first mail piece and the second mail piece;

means for determining a difference between the desired gap time and the measured gap time;

means for selecting a dwell velocity based on the difference between the desired gap time and the measured gap time;

means for determining a dwell time based on the selected dwell velocity; and means for moving the second mail piece at the selected dwell velocity for the dwell time such that the gap time between the first mail piece and the second mail piece will be substantially equal to the desired gap time between the first mail piece and the second mail piece.

40. The transport system of claim 39, wherein the means for determining a desired gap time further comprises:

means for calculating the desired gap time based on the length of the first mail piece.

41. The transport system of claim 39, wherein the means for determining a desired gap time further comprises:

a look-up table utilized to obtain the desired gap time based on the length of the first mail piece.

42. The transport system of claim 39, wherein the means for selecting a dwell velocity further comprises:

means for selecting a dwell velocity from a range of dwell velocities based on an amount of the difference between the desired gap time and the measured gap time.

43. The transport system of claim 42, wherein the means for selecting a dwell velocity further comprises:

means for selecting one of a first dwell velocity, a second dwell velocity, or a third dwell velocity, the first dwell velocity being selected if the difference between the desired gap time and the measured gap time is greater than a first predetermined threshold, the second dwell velocity being selected if the difference between the desired gap time and the measured gap time is less than a second predetermined threshold, and the third dwell velocity being selected if the difference between the desired gap time and the measured gap time is not greater then the first predetermined threshold and not less than the second predetermined threshold.

44. The transport system of claim 39, wherein the means for selecting a dwell velocity further comprises:

means for calculating a dwell velocity based on the difference between the desired gap time and the measured gap time.

45. The transport system of claim 39, wherein the means for selecting a dwell velocity further comprises:

a look-up table utilized to select a dwell velocity.

46. The transport system of claim 45, wherein the look-up table includes a corresponding dwell time for the selected dwell velocity.

47. The transport system of claim 39, wherein the means for determining a dwell time further comprises;

means for calculating a dwell time based on the dwell velocity.

48. The transport system of claim 39, wherein the means for moving the second mail piece at the selected dwell velocity further comprises:

means for decelerating the second mail piece from a first velocity to the dwell velocity; and means for accelerating the second mail piece back to the first velocity.

49. The transport system of claim 39, wherein the desired gap time is proportional to the length of the first mail piece.

50. A mailing machine transport system comprising:

a controller to control operation of the transport device to transport mail pieces along a feed path of the mailing machine;

a first motor coupled to the controller;

a second motor coupled to the controller;

a first take-away roller located at a first position along the feed path and coupled to the first motor, the first motor to drive the first take-away roller at a first velocity;

a second take-away roller located at a second position along the feed path, the second position being downstream from the first position along the feed path, the second take-away roller coupled to the second motor, the second motor to drive the second take-away roller at a second velocity; and a sensor located between the first take-away roller and the second take-away roller, the sensor coupled to the controller to provide signals to the controller, the controller using the signals from the sensor to determine a length of a first mail piece and a gap time between the first mail piece and a second mail piece, wherein the controller determines a desired gap time between the first mail piece and the second mail piece, the desired gap time being proportional to the length of the first mail piece, the controller determines a difference between the desired gap time and the measured gap time and determines a dwell velocity and dwell time based on the difference between the desired gap time and the measured gap time, and the controller causes the first motor to drive the first take-away roller at the determined dwell velocity for the dwell time when the second mail piece is in the first take-away roller such that the gap time between the first mail piece and the second mail piece will be substantially equal to the desired gap time.

51. The transport system of claim 50, wherein the controller calculates the desired gap time based on the length of the first mail piece.

52. The transport system of claim 50, wherein the controller utilizes a look-up table to determine the desired gap time based on the length of the first mail piece.

53. The transport system of claim 50, wherein the dwell velocity is selected from a range of dwell velocities based on an amount of the difference between the desired gap time and the measured gap time.

54. The transport system of claim 52, wherein dwell velocity is one of a first dwell velocity, a second dwell velocity, or a third dwell velocity, the first dwell velocity being selected if the difference between the desired gap time and the measured gap time is greater than a first predetermined threshold, the second dwell velocity being selected if the difference between the desired gap time and the measured gap time is less than a second predetermined threshold, and the third dwell velocity being selected if the difference between the desired gap time and the measured gap time is not greater then the first predetermined threshold and not less than the second predetermined threshold.

55. The transport system of claim 50, wherein the controller calculates a dwell velocity based on the difference between the desired gap time and the measured gap time.

56. The transport system of claim 50, wherein a look-up table is utilized to determine a dwell velocity.

57. The transport system of claim 56, wherein the look-up table includes a corresponding dwell time for the determined dwell velocity.

58. The transport system of claim 50, wherein the controller calculates a dwell time based on the dwell velocity.

* * * * *